US008158874B1

(12) United States Patent
Kenney

(10) Patent No.: US 8,158,874 B1
(45) Date of Patent: Apr. 17, 2012

(54) SYSTEM AND METHOD FOR DETERMINING TEMPO IN EARLY MUSIC AND FOR PLAYING INSTRUMENTS IN ACCORDANCE WITH THE SAME

(76) Inventor: Leslie M. Kenney, Wakefield, RI (US)

( * ) Notice: Subject to any disclaimer, the term of this patent is extended or adjusted under 35 U.S.C. 154(b) by 113 days.

(21) Appl. No.: 12/480,004

(22) Filed: Jun. 8, 2009

Related U.S. Application Data

(60) Provisional application No. 61/059,868, filed on Jun. 9, 2008.

(51) Int. Cl.
*G04B 13/00* (2006.01)

(52) U.S. Cl. ..... 84/612; 84/609; 84/615; 84/636; 84/477 R

(58) Field of Classification Search ..... None
See application file for complete search history.

(56) References Cited

U.S. PATENT DOCUMENTS 5,164,529 A * 11/1992 Saito ..... 84/612
6,175,072 B1 * 1/2001 Aoki ..... 84/636
7,435,891 B2 * 10/2008 Perla ..... 84/470 R
7,741,554 B2 * 6/2010 Sasaki et al. ..... 84/609
7,884,276 B2 * 2/2011 Taub et al. ..... 84/612
2003/0094093 A1 * 5/2003 Smith et al. ..... 84/609
2004/0112202 A1 * 6/2004 Smith et al. ..... 84/609
2008/0184869 A1 * 8/2008 Smith et al. ..... 84/609

* cited by examiner

*Primary Examiner* — Marlon Flectcher
(74) *Attorney, Agent, or Firm* — Keri E. Smithers, Esq.; William A. Loginov, Esq.; Loginov & Associates, PLLC

(57) ABSTRACT

A system and method for determining the appropriate tempo for early music, which may have originally lacked metronome-based time values, and for playing musical instruments according to the same. One example of such early music is the various piano works of Johann Sebastian Bach. The appropriate tempo is determined according to a number of indicators or parameters within the music score including the common time mode, the time signature, the fastest note type, and the absence or presence of any tempo words. Tempos are based around a common time beat value of 71 beats per minute and a cut-time beat value of 80. Other beats are derived using the parameters based on either of these two base values. An electronic device and/or software application may be provided for determining the appropriate tempo according to the illustrative system and displaying it according to an audio and/or visual queue.

9 Claims, 6 Drawing Sheets

SYSTEM AND METHOD FOR DETERMINING TEMPO IN EARLY MUSIC AND FOR PLAYING INSTRUMENTS IN ACCORDANCE WITH THE SAME

RELATED APPLICATIONS

This application claims the benefit of U.S. Provisional Application Ser. No. 61/059,868, filed Jun. 9, 2008, entitled SYSTEM AND METHOD FOR DETERMINING TEMPO IN EARLY MUSIC AND FOR PLAYING INSTRUMENTS IN ACCORDANCE WITH THE SAME, the entire disclosure of which is herein incorporated by reference.

FIELD OF THE INVENTION

The present invention relates to systems and methods for determining the tempo in early music. More particularly, the present invention relates to a system and method for determining the tempo of certain Baroque era music, and to a method for playing a musical instrument according to that tempo.

BACKGROUND OF THE INVENTION

The correct tempo at which to play early music (i.e., music that was composed prior to the $19^{th}$ century, before the invention and/or common availability of the metronome) has not been entirely clear, as many composers often did not provide much for direction in the music itself. With the invention of the metronome circa 1812, the tempo that a composer wanted their music to be played at was more easily determined, ascertained and standardized.

An example of this early music is from the Baroque era of European classical music (from the $17^{th}$ and early $18^{th}$ centuries), which is associated with composers such as Claudio Monteverdi, Antonio Vivaldi, George Frideric Handel, and particularly the illustrious Johann Sebastian Bach. By way of example, when Johann Sebastian Bach (also referred to simply as "Bach" herein) composed music, particularly for keyboard instruments, he scribed very little on the pages beyond the notes themselves, giving almost no direct information about the tempo at which he desired that the piece be played.

This lack of direction in the musical works of Bach has created much debate and discussion as to the true tempo at which the composer intended their musical work to be played. Also, because all of this music was composed before the invention of the metronome, the exact number of beats per minute is not entirely clear, nor were composers typically able to instruct a musician as to what the exact tempo should be.

It is believed that contemporary musicians who were directly familiar with the music of Bach and others had knowledge of the proper tempos, but this knowledge was not made public, and eventually died with the generation of musicians who originally performed Bach and other contemporary baroque composer's work.

Several attempts have been made to derive a system that is capable of determining the appropriate tempo at which to play the works of these early classical composers, and more importantly, which results in a pleasing and musically logical sound (i.e. a sound that appears to conform with accepted principles for the performance of such a piece or movement). However, systems in existence do not teach a system that is applicable to all, or even a large segment of musical works. Also, many existing systems for attempting to determine the appropriate tempo are complex and do not enable a user to quickly identify the appropriate tempo.

Some music authorities believe that because Bach did not put much notation to his music, it was intended to be played at a wide range of acceptable tempos. However, most authorities would agree that Bach must have had a system for precisely communicating tempo information to the musician. He was known by contemporary reports as a perfectionist. The system of Bach's music should be a derivative of all of the known practices of the Baroque era, and thus all of the practices available to Bach and other composers at the time of composition. While it is not presently possible to know with certainty what technique Bach or other contemporary early baroque composers employed to score and play back music at a given tempo, a novel, systematic technique that reliably yields pleasing and musically logical tempos for modern musicians is highly desirable.

Accordingly, it is desirable to provide a system and method that enables a musician to quickly and easily determine the appropriate tempo, for early baroque music, and more particularly certain pieces of Bach, where the tempo is uncertain. Furthermore, it is desirable to provide a system and method capable of providing the appropriate tempo for a wider range of musical works from the early baroque music era.

SUMMARY OF THE INVENTION

This invention overcomes disadvantages of the prior art by providing a system and method that is capable of determining the appropriate tempo at which to play early music. In general, the invention herein provides a method for determining the appropriate tempo based on a series of indicators found in a piece of music, including the common time mode, the denominator of the time signature, the notational level, which will be termed henceforth as the "fastest note type" of the work, and the type of tempo words present in the musical work. Derived tempos are based around a common time beat value of 71 beats per minute and a cut-time beat value of 80. Other beats are derived using the parameters based on either of these two base values.

In an illustrative embodiment, there is provided a system and method for determining the appropriate tempo of a piece of music that was composed prior to the invention of the metronome, when composers had their own techniques for determining and setting the tempo. The method first determines the common time mode by selecting whether it is C or ¢. This thereby provides the base tactus. Then, the denominator of the time signature is determined to determine how that parameter affects the tactus. Then, the fastest note type is determined. The fastest note type varies the tempo from tempo giusto depending on its variation from $16^{th}$ notes. The type of tempo words, if present, also varies the tempo from tempo giusto. Thus, by determining all four factors/parameters of the work, the appropriate modification tempo may be determined.

It is contemplated that C versus ¢ following each other will be dependent. Unlike proportional time signatures, such as 12/8, 2/4 etc., time signatures C and ¢ have a double meaning. Like all time signatures they indicate the number of beats in a measure. In addition they indicate the underlying speed in the music—referred to as the tactus. A tactus of C is assumed at the beginning, in case of a time signature other than C or ¢. It remains in effect in all subsequent section's time signatures until the appearance of cut time. Similarly, the tactus of cut remains in effect through all subsequent time signatures until the appearance of C. This switching is referred to as "Common Time Mode".

There is also provided by this system and method a generalized table that lists the appropriate tempo for each possible scenario of tempo indicators. This table can be incorporated into a soft-ware based lookup table that can be used to score a given musical piece with appropriate, printed metronome time markings usable by modern musicians. Likewise, the values of the table can be incorporated into a software and/or electronic hardware-based metronome that reports the correct time value to the musician for a given section/movement of a piece. This metronome can include a database of pieces so that the appropriate tempo is automatically reported (visually, audibly, etc). The tempo can change at the appropriate measure based upon knowledge of the number of measures in the piece. Alternative/in addition, the metronome system can include a switching mechanism, such as a foot pedal, which is used to advance (and/or replay) to the next programmed tempo in the piece at the appropriate time. The tempos can be determined based upon entering of the parameters (above) for each movement or section of the overall piece. The current tempos are each reported by metronome audible clicks, flashes, numerical time values, etc. by the system in the order in which they occur in the piece.

BRIEF DESCRIPTION OF THE DRAWINGS

The invention description below refers to the accompanying drawings, of which.

DETAILED DESCRIPTION

Figure 1:
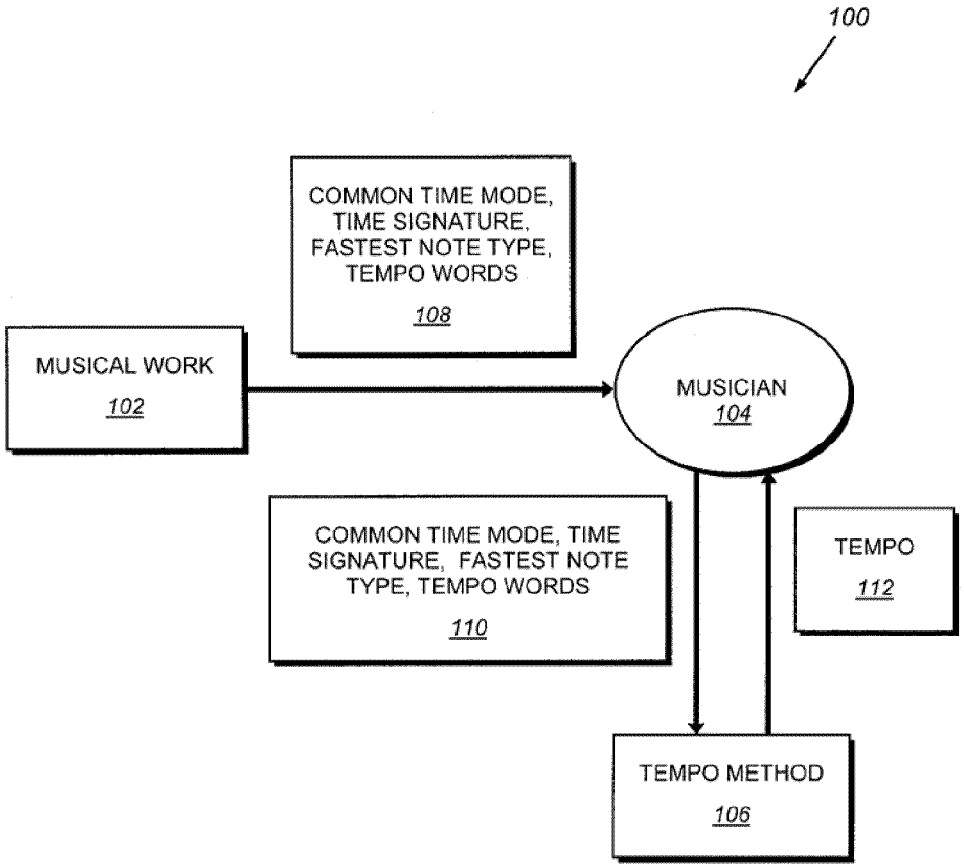
FIG. 1 is a block diagram showing an overview of an illustrative system for determining tempo.

Illustrated in FIG. 1 is a block diagram showing an overview for a tempo determination system 100 according to an illustrative embodiment of this invention. Depicted in FIG. 1 is the relative interaction between a piece of music 102, a musician 104 and the tempo method 106 according to the tempo determination system. According to the system 100, the system as used herein may be applicable to a variety of early Baroque era musical works composed prior to the advent of the metronome and particularly to the musical works of Bach. The applicability of the illustrative system and method to a particular work can be determined by 1) confirming that the work is scored generally in conformance with the rules and principles described herein and 2) playing the piece after applying the rules to determine if a pleasing and musically logical sound is achieved.

In the illustrative system and method 100, there are several factors that determine the tempo of a piece of music. These are the Common Time mode, time signature, the fastest note type of the music (the notational level) and the presence of any tempo words (discussed in further detail below). Also, in case of conflict relating to time signature and fastest note type between an upper and lower staff on a work, the performer chooses between them in determining the tempo according to this system and method. These factors are described in greater detail below.

In accordance with the illustrative system and method 100, the musician 104 first reviews the musical work 102 to determine these indicators for ascertaining the appropriate tempo for the musical work. The appropriate tempo is the tempo that, according to the illustrative system, is generally representative of the tempo at which the composer of the musical work intended it to be played, and thereby results in a pleasing and musically logical sound. As discussed above, there is no presently practical manner to precisely determine the technique employed by Bach or another contemporary composer to ascribe tempo to a given musical piece or movement (unless it was expressly stated at the time). Thus the illustrative, novel system method provides a simple, reliable and musically logical technique that appears to produce acceptable results over a wide range of pieces.

Referring further to the system and method 100 of FIG. 1, the musician determines these indicators according to step 108, and then at step 110 they are relayed into the tempo procedure 106 so the tempo may, in fact, be determined. The tempo procedure 106 determines the appropriate tempo for playing the music according to the process of FIG. 2, which will be described in greater detail below. This appropriate tempo is then relayed back to the musician 104 at step 112 so the musician can play the musical work on their musical instrument at the appropriate tempo, which as it is believed, approximates that intended by the composer. A musician can, thus, play their musical instrument according to appropriate tempo by following the tempo method.

Figure 1A:
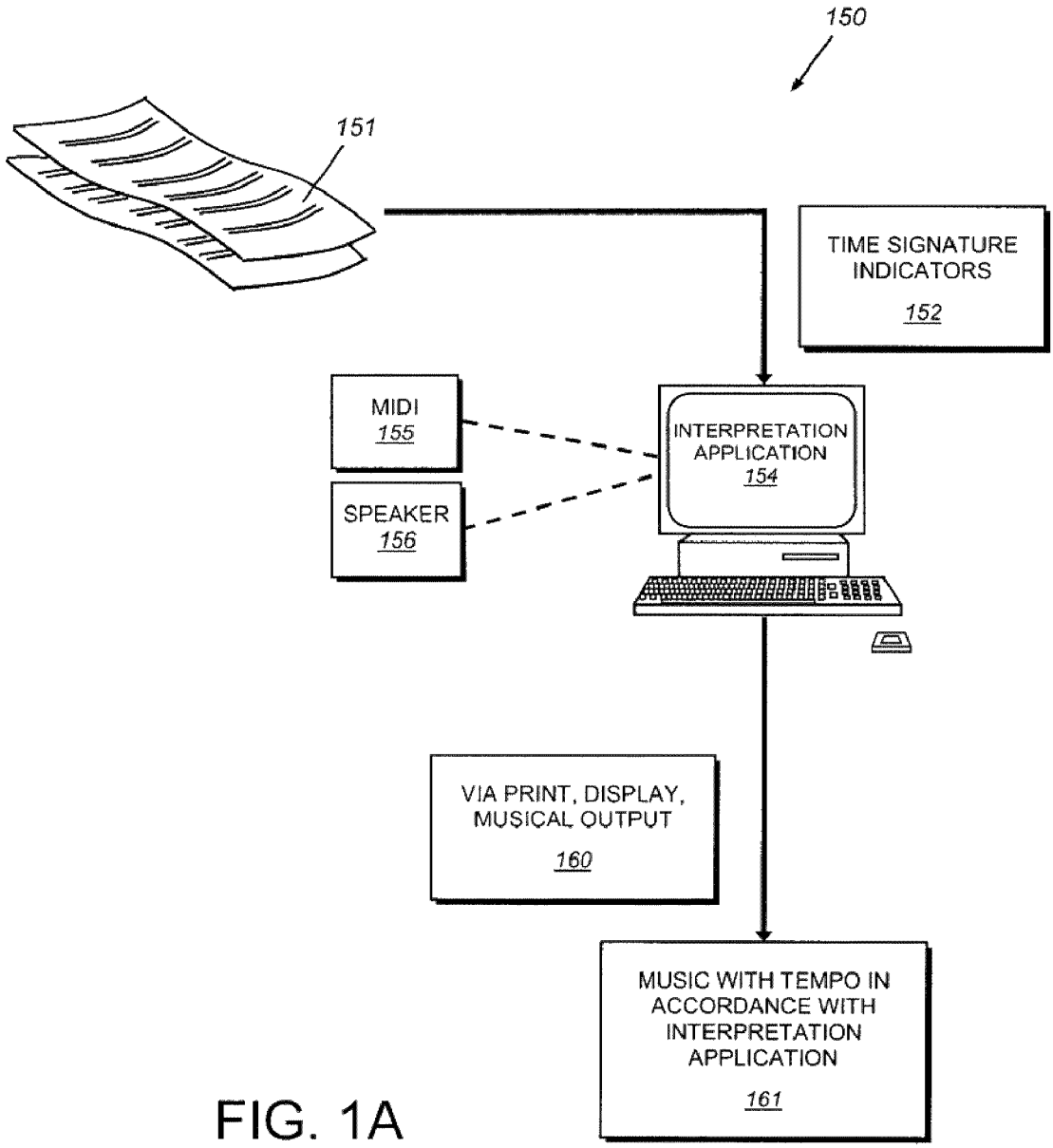
FIG. 1A is a diagram showing a tempo generation system according to the illustrative system for determining tempo.

As described below, there are various mechanisms for implementing the tempo procedure according to the illustrative system and method for determining tempo. An implementation is shown in FIG. 1A, a diagram of a tempo generation system 150. As shown, a musical work 151 is provided, having traditional time signature indicators (as well as notes and/or information related to the notes) that are used to interpret the tempo. These indicators are either input manually at 152 to a computer 153, or input to the computer 153 via electronic file input, visual scan by a scanner or other machine, and/or note/alphanumeric character recognition. The time signature indicators are input, manually or automatically, via datastream 152 to the computer 153. The computer 153 includes an interpretation application 154 that determines the appropriate tempo at which to play the work 151, according to the timing algorithm/tempo procedure described herein. The computer 153 can optionally include a MIDI (musical instrument digital interface) 155, or other music generation device, for playing the appropriate tempo. The computer 153 can also include a speaker 156 for directly playing the tempo as a metronome meat, or, in fact, playing the input notes at the interpreted tempo). In addition to these devices, the output of the interpretation application that runs the tempo procedure can be presented via print, display, or other appropriate musical devices 160.

Figure 2:
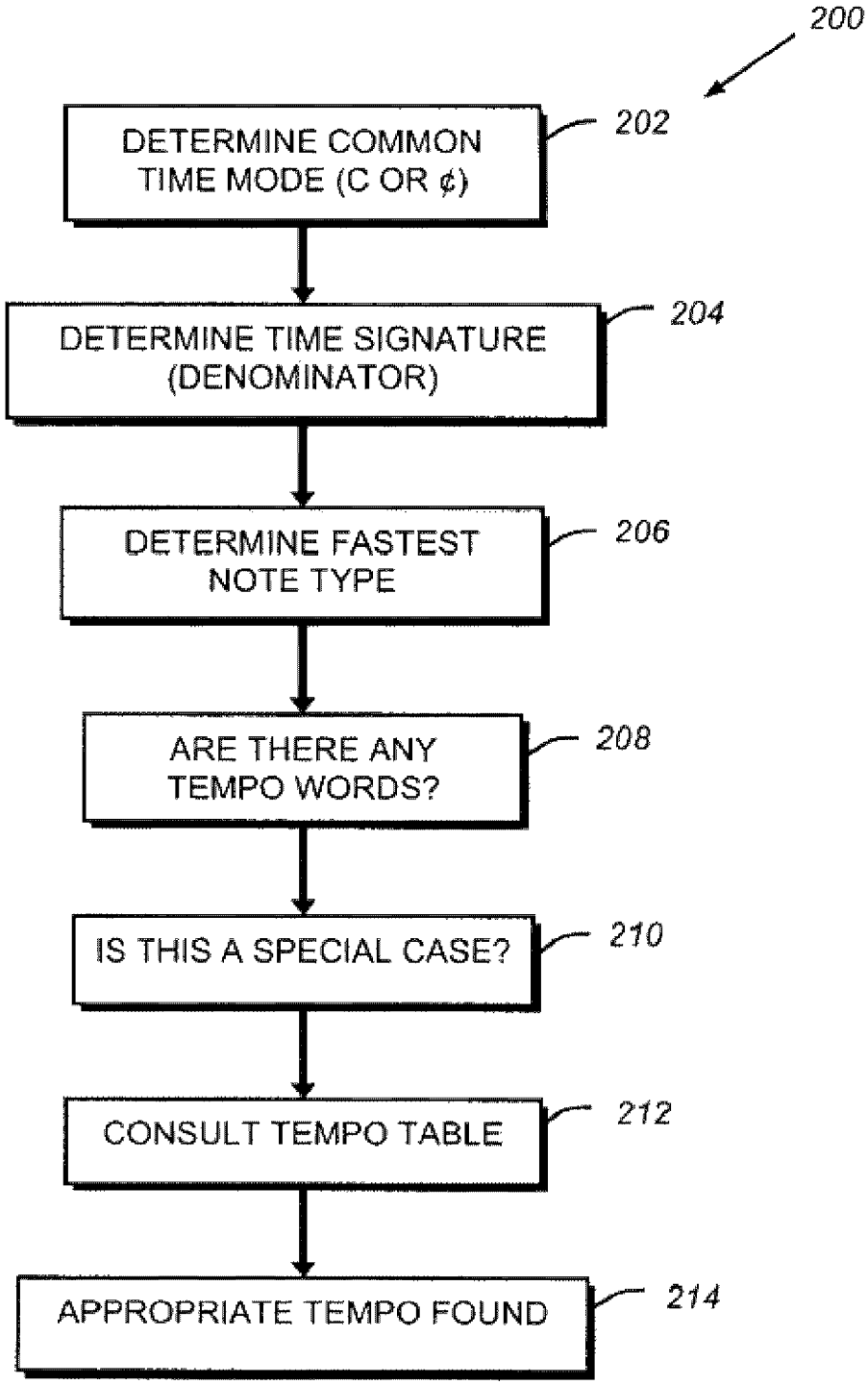
FIG. 2 is a flow diagram showing the overall method of the illustrative system for determining tempo.

FIG. 2 is a flow diagram showing the overall procedure 200 of the illustrative tempo determination system and method. According to the system and method, the time signatures, the fastest note type and the tempo words (if any) determine the tempo of the musical work. Different combinations of these indicators result in different tempos. For each combination, the tempo has been calculated according to the method of FIG. 2, as will be described in greater detail hereinafter. These tempo values have been organized into a tempo lookup table 300 illustrated in FIG. 3B. This table organizes the various tempo values contemplated by the system and method and allows a musician or an automated process to quickly and easily reference the correct tempo value for a given set of characteristics and parameters within the musical work.

Figure 6:
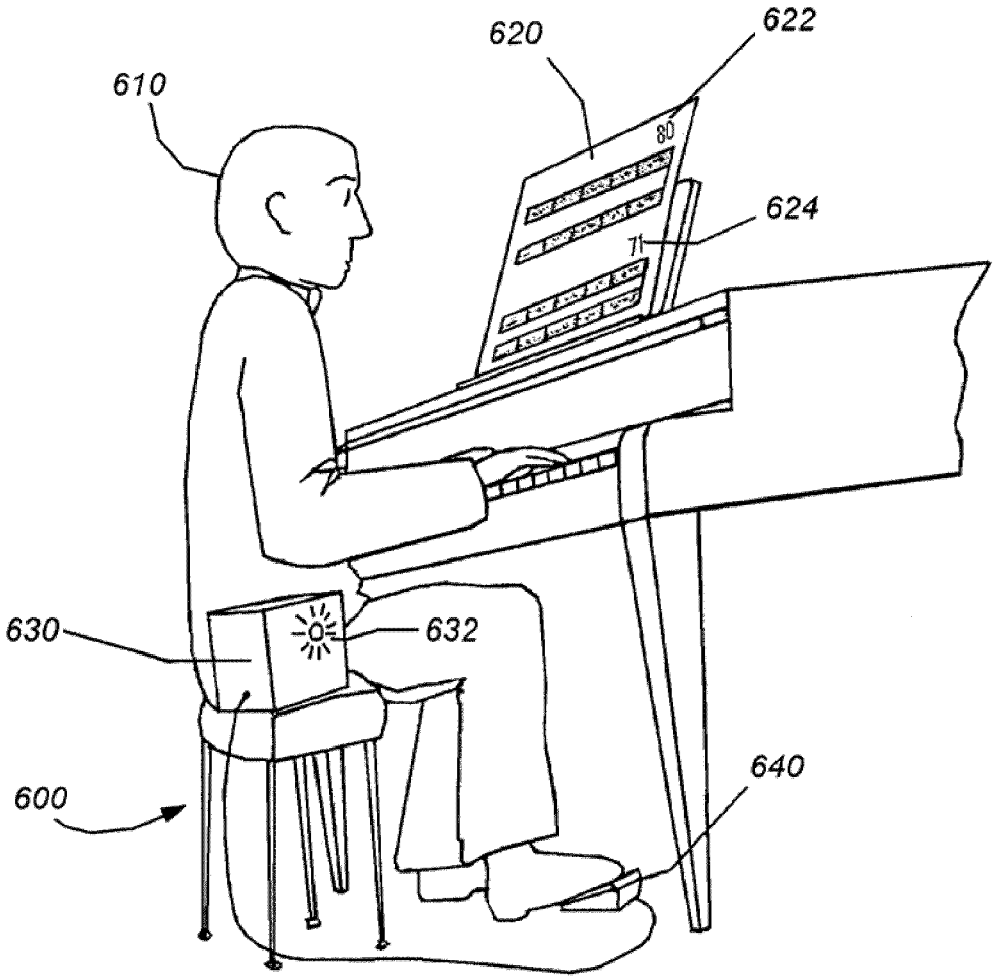
FIG. 6 is a rendering of a musician playing a piano according to the illustrative system and method for determining tempo.

With further reference to FIG. 2, according to the illustrative system and method for determining tempo, at step 202 a procedure 200 first determines the "Common Time" mode. This procedure, and the others described herein, can be performed manually, by a musician, or in a fully or partially-automated manner by executing program instructions in a computer software application (or discrete electronic device, such as an electronic metronome) for example as shown in FIGS. 1A and 6. Also, as used herein a "musician" refers to any person associated with the playing, scoring, arranging or performing of a musical piece.

An appropriate user interface can be provided for entering pertinent information from the music score and providing user-based choices, such as the prevailing time signature in the piece. This is accomplished by determining whether the time signature is C or ¢ at the beginning of the particular section of the score. As used herein, "C" signifies the semicircle notation that may be present at the beginning of a musical work and is referred to as "common time" by contemporary authorities, and "¢" signifies the semicircle with a slash through it that may be present at the beginning of a piece of music, now commonly referred to as "cut" time. Cut time in a modern context represents a simple halving of common time. However, as will be described herein, the cut time symbol, as it appears in original works actually has a meaning that differs significantly from the more modern view. It should also be noted that the illustrative system bases its tempo values in part on the ancient tradition of tactus, often related to the human heart rate, which had been used for centuries to determine the tempo for a musical piece.

Figure 4:
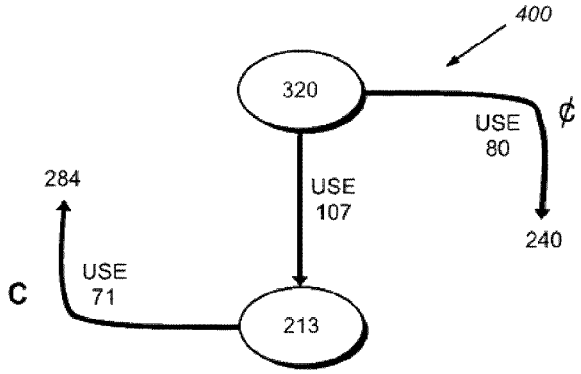
FIG. 4 is a tempo circle according to the illustrative system for determining tempo.

Accordingly, C and ¢ have a double meaning according to the illustrative system. They represent both the number of beats in the measure and also indicate the tactus. The tactus is a standard beat, from which the note speed is derived. Whether C or ¢ is present will determine the initial tactus. By way of example, as described further below, if there is a C present, that results in a tactus of 71 beats per minute, which provides a primary sub-tactus of 284 beats per measure (71×4) and an alternate sub-tactus of 213 beats per measure (71×3). If there is a ¢ present, that results in a tactus of 80 beats per minute. This provides a primary sub-tactus rate, as termed henceforth the note speed, of 320 beats per minute (80×4) and an alternate note speed of 240 beats per minute (80×3). This results in the tempo circle of the illustrative system, as illustrated in FIG. 4, which will also be described further below. Fundamentally, this tempo circle is based on the human heart rate traditional tempo. That is, 80 beats per minute is a fairly common base rate in traditional music, and 71 beats per minute can represent the heart rate of an actively healthy human—such as a performer. However, as will be described further below, a system based solely on either 71 or 80 beats per minute does not yield the desired range of tempos. Note that this meaning of c and ¢ stays in effect through numerical time signatures, so that there are two types of music notated with these numerical time signatures.

Referring further to FIG. 2, at step 204, the determination procedure 200 then derives the time signature. This is accomplished by determining the number in the denominator of the time signature. The time signature denominator could be 2, 4, 8 or 16 (among others); i.e. the beat note value is one of ½, ¼, ⅜ or 3/16. For example, if the musical work is in ¾ time, the time signature denominator is 4, and the beat note value is ¼. This changes the tempo by changing the note value of the beat, and therefore the number of subdivisions of the beat. With reference to the table of FIG. 3, where the note value of the beat box 320 shows the possible beat values of ½, ¼, ⅜ and 3/16. These accordingly change the tempos shown in boxes 330, 332, 334, 336 and 338. For example, in box 332, the tempo is 36 for a time signature of 3/8 but is 53 for a time signature of 1/4.

Then at step 206, a procedure 200 determines the fastest note type of the subject musical piece. This is accomplished by identifying the fastest note value of a movement. A human observer can accomplish this based upon a visual review of the score for the predominant fastest note type—using reasonable and ordinary judgment to filter out faster/slower ornaments that are intermittent in the piece. This process can also be executed in an automated manner by scanning for a predetermined density of a particular type of note. An arbitrary density level can be used as the metric for deciding which fastest note type applies. For example, a variation of no more than 10 percent from a predominant notation level could be acceptable to establish the predominant notation level as the procedure's chosen fastest note type. Alternatively, if a different notation from the predominant occurs only every 20 measures and/or for no more than 3 measures, then the predominant is controlling. A wide variety of discrete, or interrelated parameters can be used to determine the predominant fastest note type and these can be established as basic rules in a software application. By way of further example, Bach employs a fastest note type of the $16^{th}$ note to indicate a movement in tempo giusto (standard time) in his works. In every time signature (in tempo giusto), the speed of the $16^{th}$ note is equal to the primary note speed, which is four times the speed of the tactus. It should be noted that a small quantity of the next-fastest note value, such as ornament-like scales and arpeggios, is ignored in lighter texture music (for example the e-flat major Prelude of the second book of the *Well-Tempered Clavier*), and thus, the faster tempo is used. In denser music, such as fugues for three or more voices, the faster notes are not ignored and the slower tempo is used (for example the D-major Fugue of the second book of the *Well-Tempered Clavier*).

To determine the fastest note type, the procedure 200 identifies the fastest note type of a movement, and it can be $64^{th}$, $32^{nd}$, $16^{th}$ triplet, $16^{th}$, $8^{th}$ triplet, $8^{th}$ or $4^{er}$. The fastest note type varies the tempo as it deviates from $16^{th}$ notes at tempo giusto. As illustrated in the table 300 of FIG. 3B, tempo giusto of box 330 is $16^{th}$ note motion with no tempo words. To implement a change in tempo according to the table, the musician switches to the alternate sub tactus rate, but continues to access the tempos as set forth in the table 300. Note also that for $16^{th}$ triplets and 1/8 triplets the primary sub tactus rate is used (not shown in the table 300). Some examples of each fastest note type, from the works of Johann Sebastian Bach for keyboard instruments, each of which is incorporated by reference, are as follows:

Fastest note type of $64^{th}$: Partita 1—Sarabande;
Fastest note type of $32^{nd}$1: Partita 1—Praeludium;
Fastest note type of $16^{th}$ triplets: Partita 3—Sarabande;
Fastest note type of $16^{th}$: Partita 1—Allemande;
Fastest note type of $8^{th}$ triplets: Partita 1—Corrente;
Fastest note type of $8^{th}$: Partita 1—Minuet I & II; and
Fastest note type of $4^{er}$: Partita 1—Gigue.

According to the illustrative system and method, a change in fastest note type or the addition of a tempo word varies the tempo from tempo giusto. At step 208, the procedure 200 determines whether there are any "tempo words" present (see below). According to an illustrative embodiment of the tempo system, it is the number and type of tempo words that indicate a variation in tempo, but not the actual tempo itself. Tempo words are herein defined as word notations (typically scribed in Italian) at the beginning of a piece or section/movement that indicate the mood, rather than a particular tempo. Accordingly, the illustrative system and method groups all slow tempo words together (e.g. those with a slow-sounding mood) and all fast tempo words together (e.g. those with a fast or energetic sounding mood) without regard to the particular mood word, and then bases decisions on the type of tempo words present in the piece. Some examples of slow tempo words are: grave, adagio, largo, and andante; and some fast tempo words are: allegro, presto vivace and alla breve. By determining the tempo based on only the type of tempo words, and not the content of the words themselves, the system simplifies the tempo determination method so as to quickly and easily identify the tempo. Again, while this procedure may not precisely follow that of Bach or another composer, it does provide a systematic, pleasing and musically logical result in the exemplary works above. It should be noted that tempo words can provide a dual function in accordance with an embodiment of this system and method. In addition to providing introductions for increasing or decreasing the tempo, these words can also act to describe the mood or affect of the section of the work, and thus, different words in a group, while having an identical effect on tempo, also variably describe the mood—the mood depending upon the specific word used (e.g. the type of tempo word).

At step 210, the procedure 200 then determines if this score represents a special case, such as a Sarabande or a Gigue in which case the tempo lookup table 300 of FIG. 3 does not apply. For a Sarabande, $32^{nd}$ notes are always assumed to be present when determining fastest note type, so that the tempo is set to 53 if 16ths or $32^{nd}$'s are the fastest note type and 36 if there are $64^{th}$ notes present in C, and 60 if 16ths or $32^{nd}$'s are the fastest note type and 40 if there are $64^{th}$ notes present in ¢. For a Gigue movement, a musician assumes a "fast" tempo marking (for, example allegro) unless the beat note value is 3/16 (and the fastest note type is $1/16^{th}$), which provides a tempo or 94 or 107, and which are already the fastest tempos, and thus, cannot be notated any faster—as these are the fastest tempos contemplated by the system and method. These are special cases for certain dances and are based in part on traditional time signatures for such pieces.

Figure 3A:
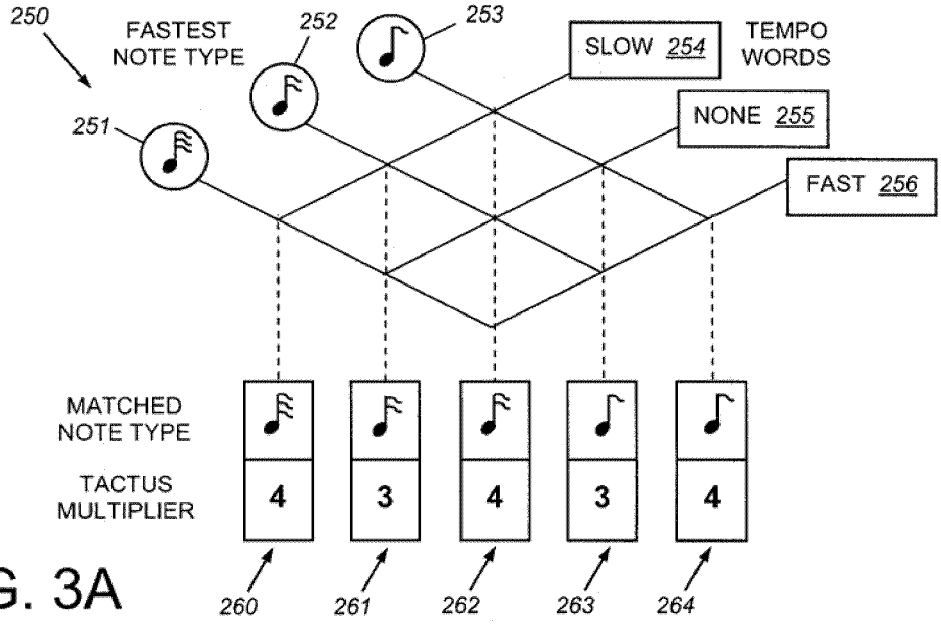
FIG. 3A is a tactus multiplier lookup table showing the tactus multiplier applicable for the various combinations of indicators in the musical works, according to the illustrative embodiment.
Figure 3B:
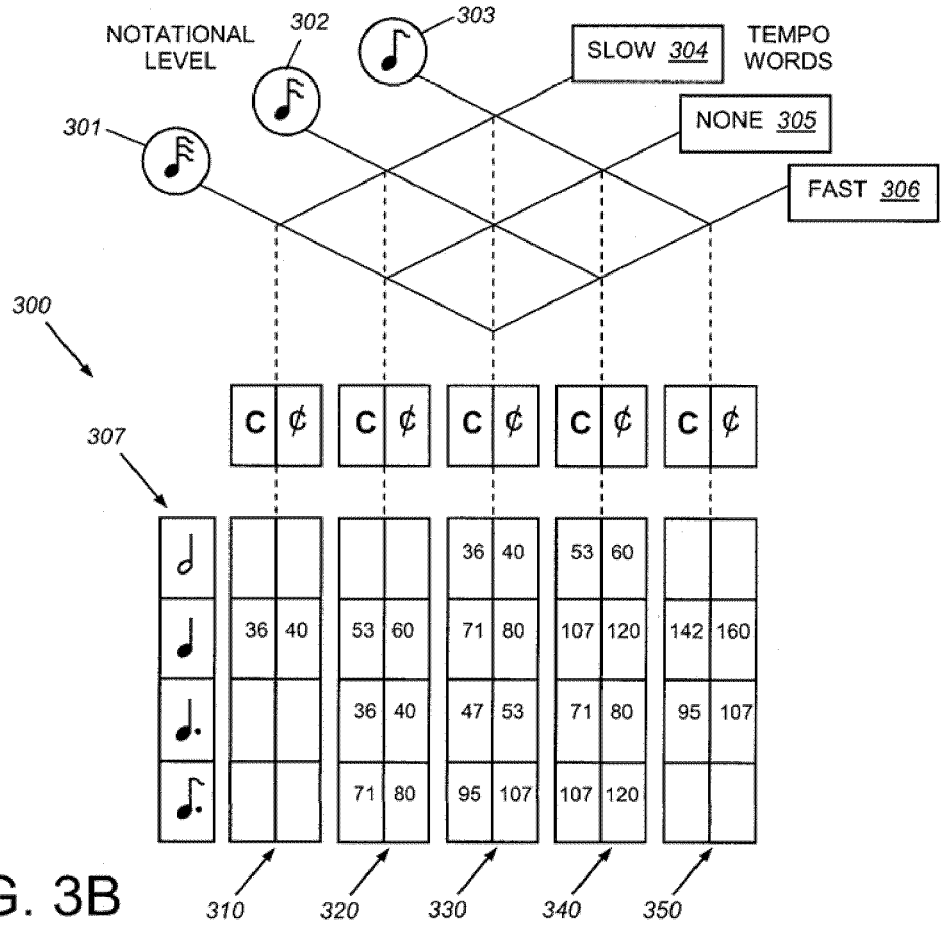
FIG. 3B is a tempo lookup table showing all of the tempos that result from the various combinations of indicators in the musical works, according to the illustrative system and method.

The procedure can be implemented using the fastest note type and the number of tempo words to determine the tactus multiplier and the appropriate tempo, as shown in FIGS. 3A and 3B. FIG. 3A is a tactus multiplier lookup table 250 showing the different tactus multipliers associated with each of the different tempo inputs. As shown, the fastest note types of a $32^{nd}$ note 251, a $16^{th}$ note 252 and an $8^{th}$ note 253 are shown. The table also accounts for slow tempo words 254, no tempo words 255 and fast tempo words 256. The combination of the fastest note type and tempo words produces the various tactus multipliers. For example, slow tempo words 254 applied to a piece having $32^{nd}$ note fastest note type results in a tactus multiplier of 4 (at 260). A slow tempo word 254 combined with $16^{th}$ note as a fastest note type results in a tactus multiplier of 3 (at 261). No tempo words 255 combined with a fastest note type of $32^{nd}$ note type (252), results in a tactus multiplier of 4 (at 262). The same note type (252) with a fast tempo word 256 results in a tactus multiplier of 3 at 263. And finally, a tactus multiplier of 4 at 264 results, for example, from a fast tempo word 256 and the fastest note type of $8^{th}$ notes.

The different tempos associated with each of the different inputs for the time signature indicators are organized into the tempo lookup table 300 of FIG. 3B. As shown, the fastest note types are broken down into $32^{nd}$ notes (301), $16^{th}$ notes (302) and $8^{th}$ notes (303). The lookup table also takes the tempo words into consideration, slow tempo words at 304, no tempo words at 305 and fast tempo words at 306. The various combinations result in the tempo blocks 310, 320, 330, 340, and 350, which vary depending on the note value of the beat (307). The note value of the beat can be, as descending down the box 307, half, quarter, three-eighths or three-sixteenths. Each of the note value of the beat correspondingly affects the tempo. As discussed herein, the appropriate tempo, as contained in this lookup table, is representative of the tempo derived from the tempo procedure described herein.

Once the procedure applies the appropriate tempo at which to play a musical work, the system and method also provides for switching between the various tempos as the score progresses through different sections and movements. This is provided for in the table of FIG. 3B, but by way of further illustration, FIG. 4 shows a graphical representation of the conceptual framework for switching between the various note speeds. As stated above, FIG. 4 illustrates the primary and alternate note speeds for the base rates of 80 beats per minute and 71 beats per minute. Note that 71 beats per minute is the standard heart rate tempo as described above. However, another base tempo is needed to provide the full range of values, relative to the cut-time scale. By mathematical deduction, employing the tempo table of FIG. 3, the most logical base tempo is 80 beats per minute. Other base cut-time tempos (that mathematically allow the steps provided in the table) produce a value that is too slow over at least part of the range, or that is too fast. If a user wishes to switch between C (213 beats per minute) and ¢ (320 beats per minute), he or she applies a tactus of 107. A user wishing to switch from 213 to 284 uses a tactus of 71 and a user switching from 320 to 240 uses a tactus of 80. This tempo circle illustrated in FIG. 4 provides the basis for the illustrative system and method for determining tempo, by indicating how a musician switches between the various sub-tactus. It includes the common time base tempo of 80 and the cut time base tempo of 71.

Note that the tempo circle of FIG. 4 is only an exemplary tempo circle of the illustrative tempo determining system and method. The four rates of 213, 240, 284 and 320 are only exemplary note speeds, with the base rates of 80 and 71 beats per measure. The tempo circle has a variable starting point, and the tempo circle would accordingly vary depending on what the base rate is. In general, the tempo circle begins with a standard pulse of 213 beats per minute, plus or minus 15%. Then the remaining note speeds of the tempo circle are a second pulse that is half greater than the standard, a third pulse that is a third greater than the standard, and a fourth pulse that is an eighth greater than the standard. The tempo circle shows the relationship between the different pulse rates according to the illustrative system and method.

According to the illustrative system and method, in addition to enabling a performer to quickly and accurately determine the appropriate tempo for a given piece of music, it also makes it possible for the performer to reproduce a variety of different tempos without having to reference a conventional metronome. The performer follows a four step process to do this. They first analyze the music to determine the matched note speed and the desired note speed. They then establish one of the note speeds by recalling a piece of music utilizing that note speed. Then, the performer uses the rhythmic substitutions and changes illustrated in FIG. 4 to switch to the desired note speed. And finally, the performer plays the piece of music according to the illustrative system and method, by matching a note speed to the particular note value speed.

Given the relative ease of use and naturalistic nature of the tempo circle of FIG. 4, it is contemplated that the procedures and techniques derived from its use can form the basis of music educational materials that would prove highly effective in conveying basic tempo principles to a student and more advanced performer.

There are also other special rules or procedure steps that may be associated with the pre-metronome musical works, in accordance with the illustrative system and method, to assist in determining the appropriate tempo. While broader applicability is expressly contemplated, these procedure steps are particularly applicable to various musical works (piano works for example) of Johann Sebastian Bach. These special rules can be determined during step 210 of FIG. 2 in which any special cases can be identified.

For example, in accordance with the illustrative tempo determination system and method, when the score includes double time signatures, the tempo is to be treated differently depending on how they are notated. When two time signatures are provided on the same staff, the first being C or ¢, and the second being a proportional time signature (e.g. 3/4, 12/8, etc.), then the C or ¢ specifies the tactus, and the proportion specifies the meter and the tempo. Alternatively, if two time signatures are provided, a different time signature occurring on each staff, then the performer determines the appropriate time signature to be used, manually by looking at the work or by inputting the options to be determined by a computer or other appropriate device.

Figure 5:
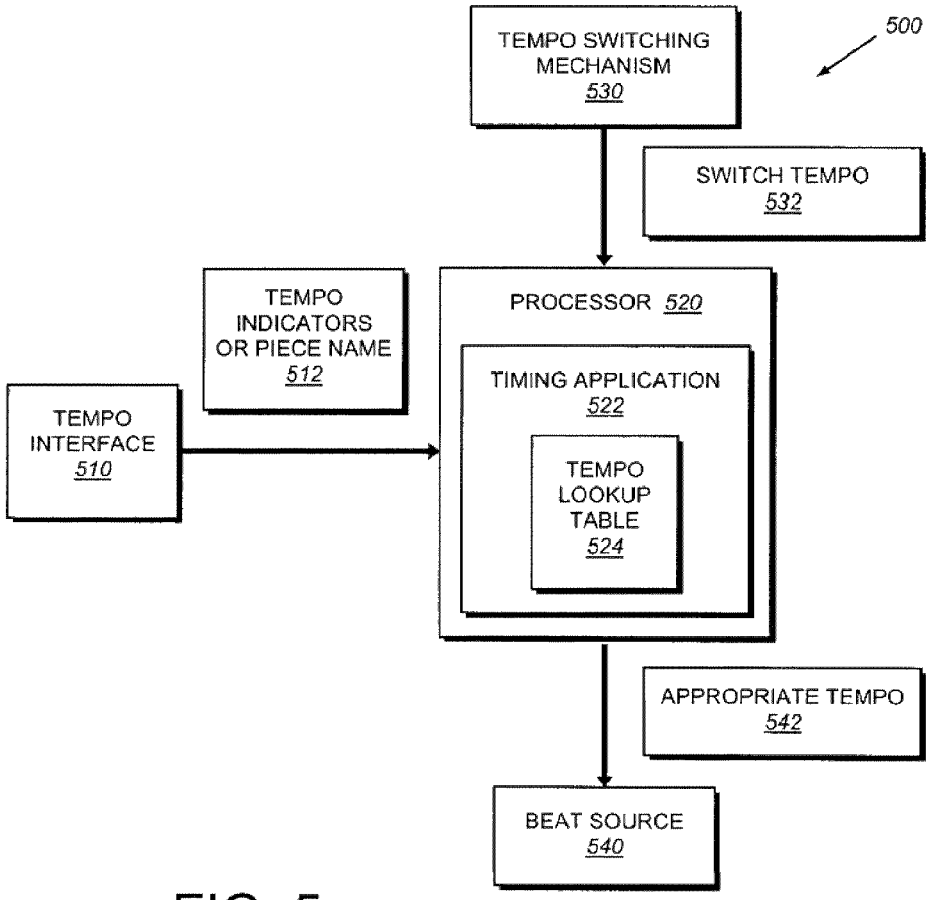
FIG. 5 is a block diagram showing an illustrative metronome system according to the illustrative system and method for determining tempo.

As discussed generally above, the system and method of this invention can be implemented using computer-readable program instructions or another implementation that employs an electronic device to carry out the procedures described herein. One such device is an electronic metronome that can be programmed to provide the appropriate tempo for each movement using lights, sound, a digital readout of time value and/or another indicia to cue the musician. Such an exemplary metronome system 500 is illustrated in FIG. 5. The illustrative metronome system 500 is capable of determining the appropriate tempo based upon information input by a musician as applied to the tempo procedure described herein. The illustrative metronome then provides the appropriate tempo, either audibly, visually, or both, to aid a musician in their performance.

In the illustrative metronome system 500, there is provided an interface 510 in communication with a processor 520. The interface can be a keypad, button set or alphanumeric touch pad, among other types. A user may enter a series of inputs containing the indicators found in the musical work, which are required by the procedure of FIG. 2 to determine the proper tempo. A "user" is defined herein to signify a performer or other musician desiring to acquire the tempo of a particular musical work and/or movement. These indicators are relayed to the processor via a data stream 512. The processor may implement a timing application 522 (analogous to the interpretation application of FIG. 1A) that contains the lookup table 300 for determining the appropriate tempo. The processor can be an acceptable microprocessor, state machine logic or equivalent component. The memory associated with the processor allows it to store each tempo in an overall sequence of movements or discrete sections or the piece. Switching between tempos as the musician moves from one movement/section to the next can be accomplished in a variety of ways, as described further below. Since the tempos in subsequent sections may depend upon the parameters entered at the beginning of the work, the processor calculates later tempos in part based upon the initial entries made. A button or key on the metronome may allow the musician to delineate between each piece, time mode or other defining parameters so that the sequence of tempos played out by the metronome are all associated with the same piece. As an option, the user can input the number of measures that a particular tempo is present so that the metronome automatically switches after counting the predetermined number of beats/measures. Of course this automatic tempo switching function relies upon the musician keeping correct time and neither skipping nor adding beats.

Alternatively, the processor 520 may be equipped with a database of musical works and appropriate tempos for those respective songs. In that case, a user may enter a particular piece's title into the interface 510 to be relayed to the processor 520 via the data stream 512. The processor 520 then accesses the appropriate tempo from the database. As a piece may contain a plurality of tempo sequences, the database can include each tempo within the overall score in proper sequence and even the number of measures that the particular tempo is active.

Where the metronome system 500 stores a sequence of tempos—typically corresponding to the movements of the work, it may also be provided with a tempo switching mechanism 530. This may be in the form of a foot pedal or other acceptable mechanism for sending a signal to the processor 520 to notify it of a change in tempo. When triggered by the switching mechanism, the metronome system advances to the next tempo in the programmed piece. This is particularly useful for playing pieces that are stored in the processor 520 because the tempos are already known. In this manner, a musician may notify the processor via the tempo switching mechanism 530 to switch the tempo when he or she reaches the appropriate point in the score. This pulse is sent to the processor via data stream 532. The pedal can include a forward and reverse setting or simply step through all recorded tempos (and back to the first tempo) if the musician wishes to replay a given section or jump ahead to a later section. It is also contemplated the metronome may also be used in a "dumb" mode, by pressing the appropriate mode and selecting a numerical beat value.

Once the appropriate tempo has been determined by the processor 520, it is relayed to a beat source 540 via data stream 542. The beat source 540 then plays or displays the appropriate tempo. The beat source may include a sound or light source for either playing an audible tone to keep tempo or displaying a light beam.

Additionally, the interface 510 may be provided with a switch for selecting between the audio or visual display media (such as lights, flashing digits, beeps, etc.), or may alternatively display both methods of keeping tempo.

In this manner, the exemplary metronome system may be in the form of a simplified metronome containing the four most basic note speeds. These may enable a performer to play music at the appropriate tempo with the basic note speeds. This simplified metronome may play the four base note speeds of 284, 213, 320 and 240 beats per minute, and allows for a variance in note speed.

The use of such an exemplary metronome system as well as scoring of music with metronome-based time values and the playing of an instrument (piano in this example) in accordance with this system and method is illustrated in FIG. 6. As shown, a musician 610 utilizes the illustrative metronome system 600 to play the piece of music 620. The piece of music 620 has also been printed with the appropriate tempo as an exemplary tactus of 80 beats per minute at location 622 in the score of the piece of music and an exemplary tactus of 71 beats per minute at location 624 in the score, based upon a scoring technique that employs the illustrative system and method. These tactus are the result of performing the illustrative tempo determination system and method.

In the illustrative system, the interface 630 may have software that is pre-programmed with the piece of music 620. In this manner, the interface 630 may contain the various appropriate tempos for the piece of music and the musician 610 may employ a foot pedal 640 (the switching mechanism 530 of FIG. 5) to switch between the various tempos at the appropriate point in the piece of music. The illustrative interface 630 shows a light 632 to visually queue the appropriate tempo. However, it is expressly contemplated that the interface 630 may be provided with an alternate queue such as a speaker for an audio queue, and may be any appropriate known method for indicating tempo.

For instances when the piece of music is not already programmed into the system, the musician may manually enter the time signatures and other indicators of tempo to determine the appropriate tempo. The system may be used in the same manner to switch between tempos. The appropriate tempos for a particular piece of music can thus be pre-programmed or may be determined on-demand, as the program determines tempo according to a series of inputs. In this manner, once a piece of music is programmed into the processor, there is no need to program again. The appropriate tempos will be there for the entire musical work every time.

The illustrative tempo determination method may also be embodied in a computer program containing instructions for following the procedure steps 200 as outlined in conjunction with FIG. 2 above. This computer program would enable a musician to input the indicators for determining appropriate tempo and would then provide the musician that appropriate tempo. That tempo can be displayed on the computer speaker and/or monitor or via an interconnected peripheral. The program can also be provided to portable devices, such as a personal digital assistant (PDA), which can serve as a convenient pocket metronome. Data on the given piece can be entered via the PDA's graphical user interface using known interface techniques and acted upon by the PDA's processor in accordance with the illustrative system and method.

It should be clear to those of ordinary skill that the tempo determination system and method, and technique for playing an instrument in accordance therewith provides a predictable, historically acceptable, musically logical and pleasing technique for scoring and performing early music. This technique, while complex enough to deal with a range of timescales, tempo markings and notation types, is still straightforward enough to be employed by even novice musicians.

It should also be clear that the tempos determined herein can be directly notated as numerical metronome time values (for example, notations 622 and 624 above) on a musical piece and, thus, this invention should expressly include musical pieces notated with numerical time values in accordance with the procedures herein or an edition of sheet music containing lists of tempo, organized by movement.

The foregoing has been a detailed description of illustrative embodiments of the invention. Various modifications and additions can be made without departing from the spirit and scope of this invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. For example, the musical works herein have been studied in conjunction with the piano and other keyboard instruments but the principles described herein have more widespread applicability. Moreover, as stated, any or all of the processes described herein can be performed by electronic hardware, software including program instructions of a computer-readable medium or a combination of hardware and software. Accordingly, this description is meant to be taken only by way of example, and not to otherwise limit the scope of this invention.

What is claimed is:

1. An electronic system for determining and displaying an appropriate tempo of an early piece of music to a user musician, said electronic system comprising:

a memory constructed and arranged to store a plurality of tempo values corresponding to a plurality of sections of the piece of music and to;

said memory comprising a lookup table for organizing multiple different tempo values;

an interface into which a user enters parameters including common time mode, a time signature, a fastest note type, and a type of tempo words corresponding to a section of the piece of music;

said interface including a user musician input device for entering parameters;

a processor that determines the appropriate tempo for the section based upon the parameters;

a data stream for relaying the parameters including tempo from the interface to the processor;

a display, responsive to the processor, that provides the appropriate tempo to the user as at least one of an audible and visual beat, and for displaying each of the tempo values in sequence; and a switching mechanism coupled to said processor controlled by said user musician for switching between the different tempos stored in said lookup table during the piece of music.

2. The electronic system as set forth in claim 1 wherein the interface has four positions for determining the tempo.

3. The electronic system as set forth in claim 2 wherein the four positions correspond to four tactus rates of 213, 284, 240 and 320 beats per minute.

4. The electronic system as set forth in claim 1 wherein the piece of music comprises a piano piece by Johann Sebastian Bach.

5. The electronic system as set forth in claim 1 wherein the switching mechanism comprises a foot pedal controlled by the user musician.

6. The electronic system as set forth in claim 1 wherein the lookup table categorizes tempo words as one of slow tempo words, no tempo words and fast tempo words.

7. The electronic system as set forth in claim 1 wherein the interface is one of a keypad, button set and touch pad.

8. The electronic system as set forth in claim 1 wherein the switching mechanism automatically switches to a different tempo after counting a predetermined number of measures.

9. The electronic system as set forth in claim 1 wherein the switching mechanism comprises a pedal including forward and reverse settings.

* * * * *